US012303769B2

(12) United States Patent
Ouellet

(10) Patent No.: US 12,303,769 B2
(45) Date of Patent: May 20, 2025

(54) HOCKEY GOALTENDER GLOVE

(71) Applicant: SPORT MASKA INC., Montreal (CA)

(72) Inventor: Francis Ouellet, Montréal (CA)

(73) Assignee: SPORT MASKA INC., St-Laurent (CA)

( * ) Notice: Subject to any disclaimer, the term of this patent is extended or adjusted under 35 U.S.C. 154(b) by 0 days.

(21) Appl. No.: 18/561,380

(22) PCT Filed: Jul. 29, 2022

(86) PCT No.: PCT/CA2022/051167
§ 371 (c)(1),
(2) Date: Nov. 16, 2023

(87) PCT Pub. No.: WO2023/004513
PCT Pub. Date: Feb. 2, 2023

(65) Prior Publication Data

US 2024/0226703 A1 Jul. 11, 2024

Related U.S. Application Data

(60) Provisional application No. 63/227,471, filed on Jul. 30, 2021.

(51) Int. Cl.
*A63B 71/14* (2006.01)
*A63B 102/24* (2015.01)

(52) U.S. Cl.
CPC ..... *A63B 71/143* (2013.01); *A63B 2102/24* (2015.10)

(58) Field of Classification Search
CPC ..... A63B 71/143; A63B 71/14; A41D 19/01523; A41D 19/01588; A41D 19/015
See application file for complete search history.

(56) References Cited

U.S. PATENT DOCUMENTS 1,465,830 A * 8/1923 Raymond ..... A63B 71/143 2/19
2,995,756 A * 8/1961 Latina ..... A63B 71/143 2/19

(Continued)

FOREIGN PATENT DOCUMENTS

CA 2115526 8/1995
CA 2404408 9/2002

*Primary Examiner* — Jillian K Pierorazio
(74) *Attorney, Agent, or Firm* — Norton Rose Fulbright Canada

(57) ABSTRACT

A hockey goaltender glove includes a front side defining a puck-receiving cavity, a rear side, a palm section extending from a glove opening and a finger section extending from the palm section. A hand-receiving space is defined between the front side and the rear side and communicating with the glove opening. A palm protective member, between the front side and the hand-receiving space, includes a wrist edge proximate the opening, a metacarpophalangeal (MCP) edge opposite the wrist edge, and curved portion ending at the MCP edge. The MCP edge is located between the glove opening and the glove end and proximate to MCP joints of the hand of the wearer. The MCP edge defines a single hinge line about which the finger section bends in relationship to the palm section, when the glove is moved from an open configuration to a closed configuration to close the puck-receiving cavity.

20 Claims, 9 Drawing Sheets

(56) References Cited

U.S. PATENT DOCUMENTS

| | | | | | |
|---|---|---|---|---|---|
| 3,300,787 | A * | 1/1967 | Denkert | A63B 71/143 | 2/19 |
| 4,121,824 | A * | 10/1978 | Hirschfield | A63B 69/0002 | 2/19 |
| 5,511,244 | A * | 4/1996 | Shikatani | A63B 71/143 | 2/161.1 |
| 5,551,083 | A * | 9/1996 | Goldsmith | A63B 71/143 | 2/161.1 |
| 5,671,477 | A * | 9/1997 | Aoki | A63B 71/143 | 2/161.1 |
| 5,850,633 | A * | 12/1998 | Lovin | A63B 71/143 | 2/19 |
| 5,976,036 | A * | 11/1999 | Jackson | A63B 69/0002 | 2/19 |
| 6,292,946 | B1 * | 9/2001 | Angione | A63B 71/141 | 2/19 |
| 7,437,773 | B2 * | 10/2008 | Aoki | A63B 71/143 | 2/161.1 |
| 2002/0013961 | A1 * | 2/2002 | Kleinert | A41D 19/015 | 2/161.1 |
| 2003/0014805 | A1 * | 1/2003 | Morrow | A63B 71/143 | 2/161.1 |
| 2004/0103465 | A1 * | 6/2004 | Kleinert | A63B 71/146 | 2/19 |
| 2010/0154106 | A1 * | 6/2010 | Hammons | A41D 19/01523 | 2/455 |
| 2014/0259256 | A1 * | 9/2014 | Smith | A63B 71/143 | 2/16 |
| 2016/0303464 | A1 * | 10/2016 | Smith | A63B 71/143 | |
| 2017/0127739 | A1 | 5/2017 | Bailey | | |

* cited by examiner

HOCKEY GOALTENDER GLOVE

TECHNICAL FIELD

This disclosure generally relates to sports protective equipment and, more particularly, to gloves worn by ice hockey goaltenders.

BACKGROUND

Ice hockey goaltenders wear a different type of glove on each hand, namely a "blocker" on the hand used to hold the stick and a catching glove (sometimes called a trapper or catch glove or simply goalie glove) on the other hand which is used primarily to catch a flying puck or to trap a puck on the ice. The present disclosure relates specifically to the later type of gloves, namely a hockey goaltender catching glove which will be referred to herein simply as a "goalie glove", or simply "glove".

A goalie glove usually includes a main glove portion having a pocket between a finger portion and a thumb portion for catching the puck, and a protective cuff portion for protecting the palm and wrist of the hand wearing the glove. While needing to protect the wearer, goalie gloves must still provide some degree of flexibility such as to permit the goalie to comfortably close his or her hand when catching a puck. While existing goalie gloves are suitable for their intended purposes, improvements are nonetheless sought.

SUMMARY

In one aspect, there is provided a hockey goaltender glove, comprising: a front side at least partially defining a puck-receiving cavity, a rear side opposite the front side, the front side and the rear side extending from a glove opening for receiving a hand of a wearer to a glove end opposite the glove opening, a palm section extending from the glove opening and a finger section extending from the palm section to the glove end, and a hand-receiving space being defined between the front side and the rear side and communicating with the glove opening; and a palm protective member located between the front side and the hand-receiving space, the palm protective member having a wrist edge proximate the opening, a metacarpophalangeal (MCP) edge opposite the wrist edge, the MCP edge located between the glove opening and the glove end and proximate to MCP joints of the hand of the wearer, and a curved portion ending at the MCP edge; wherein the MCP edge defines a single hinge line about which the finger section bends in relationship to the palm section, when the hockey goaltender glove is moved from an open configuration to a closed configuration to close the puck-receiving cavity.

The hockey goaltender glove as defined above and described herein may also include one or more of the following features, in whole or in part, and in any combination.

In some embodiments, the curved portion has a bottom-most location substantially aligned with the MCP joints of the hand of the wearer.

In some embodiments, a finger padding is secured to the palm protective member, the palm protective member having a stiffness greater than that of the finger padding, the finger padding extending from a location proximate or at the glove end towards the wrist edge.

In some embodiments, a strap extends through slots defined by the palm protective member, the strap defining a full loop around the hand-receiving space.

In some embodiments, the strap is in register with the curved portion of the palm protective member.

In some embodiments, a rear assembly is located between the rear side and the hand-receiving space, the rear assembly including straps for securing the hand within the hand-receiving space, the straps including a first strap wrapping around the hand-receiving space.

In some embodiments, the first strap extends a full circumference around the hand-receiving space.

In some embodiments, a front assembly defines the front side, the straps including a hand strap connected to the front assembly at two spaced-apart locations, the hand strap extending partially around the hand-receiving space.

In some embodiments, the hand strap has a bottom edge being U-shaped, the bottom edge extending from a first location of the two spaced-apart locations towards a center portion of the hand strap, and extending from the center portion towards a second location of the two spaced-apart locations, the center portion substantially aligned with a pivot axis of a wrist of the wearer.

In some embodiments, the hand strap has two adjustable strap portions each extending from a respective one of the first location and the second location towards the center portion.

In some embodiments, the first strap is slidably received within a sleeve defined by the hand strap.

In some embodiments, a finger protective member is located between the front side and the hand-receiving space, the finger protective member extending from the glove end towards the palm protective member.

In some embodiments, the finger protective member has a bottom edge aligned with or proximate the MCP edge of the palm protective member.

In some embodiments, the finger protective member is slidable relative to a front skin defining the front side.

In another aspect, there is provided a hockey goaltender glove adapted to be worn on a hand of a wearer, the hand having a back side, a palm side, four fingers, and a thumb, the hockey goaltender glove comprising: a palm section, a thumb section extending from the palm section for receiving the thumb, and a finger section extending from the palm section for receiving the four fingers; a pocket bridging a gap between the finger section and the thumb section; a wrist section defining an opening of the hockey goaltender glove via which the hand is inserted in the hockey goaltender glove, the wrist section leading to the palm section; and a palm protective member facing the palm side of the hand and overlapping the wrist section and extending towards the finger section, the palm protective member having a wrist edge proximate a wrist of the hand, a metacarpophalangeal (MCP) edge opposite the wrist edge, a lateral edge extending from the wrist edge to the MCP edge, and a medial edge opposite the lateral edge and extending from the wrist edge to the MCP edge, the MCP edge located above MCP joints of the hand of the wearer, the MCP edge defining a single hinge line about which the finger section bends in relationship with the palm section from an open configuration of the hockey goaltender glove to a closed configuration of the hockey goaltender glove.

The hockey goaltender glove as defined above and described herein may also include one or more of the following features, in whole or in part, and in any combination.

In some embodiments, the palm protective member has a curved portion extending from the MCP edge towards the wrist edge to follow a shape of the fingers.

In some embodiments, the curved portion has a bottom-most location substantially aligned with the MCP joints of the hand of the wearer.

In some embodiments, a finger padding is secured to the palm protective member, the palm protective member having a stiffness greater than that of the finger padding, the finger padding extending within the finger section and covering at least a portion of a palm of the hand.

In some embodiments, a strap extends through registering slots defined by the palm protective member and by the finger padding, the strap defining a full loop around the palm section that receives the hand.

In some embodiments, the strap sits below the MCP joints of the hand of the wearer.

Many further features and combinations thereof concerning the present improvements will appear to those skilled in the art following a reading of the instant disclosure.

Figure 1:
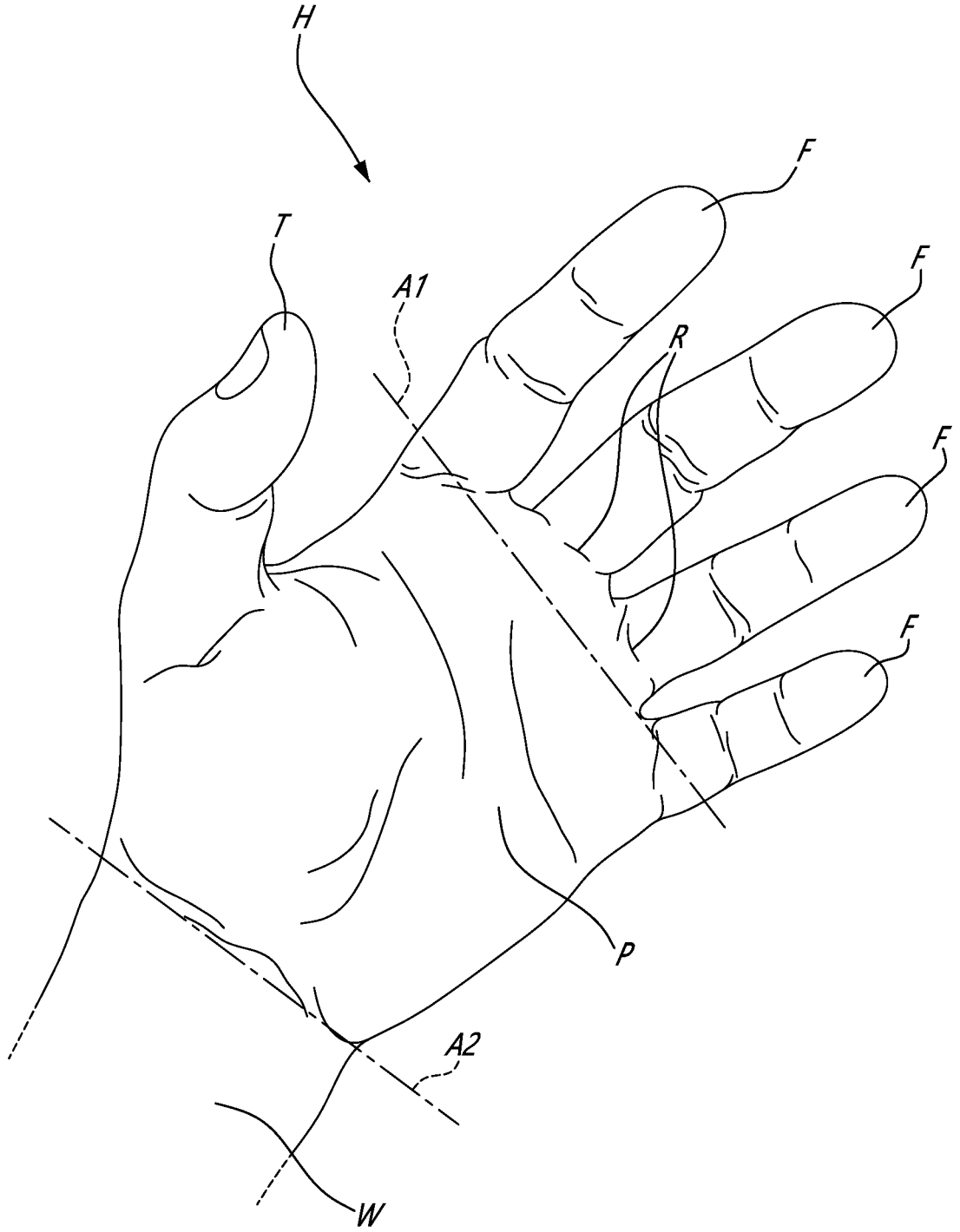
FIG. 1 is a plan view of a hand.

FIG. 1 shows a hand, a left hand in the present case, generally at H. The hand H includes four fingers F and a thumb T. The hand H has a palm P on a front, palm, or inner side of the hand H. Each of the fingers F is pivotable relative to the palm P at their respective metacarpophalangeal ('MCP') joints (simply "finger joints" or "knuckles" herein). While slight differences in range of movement and precise location pivot axis for each finger may exist, for the purposes of the present disclosure the four fingers F may be pivoted in relationship to the palm P about a collective or common first pivot axis A1 that is a substantially linear axis, although it may be slightly curved. The first pivot axis A1 is located slightly below roots R of the fingers F; the roots R being defined as a location where the fingers F meet the palm P (i.e. at or proximate to the metacarpophalangeal joints. The first pivot axis A1 substantially registers with knuckles at intersections between the fingers F and the palm P. The hand H also defines a second pivot axis A2 between the palm P and a wrist W.

Figure 2:
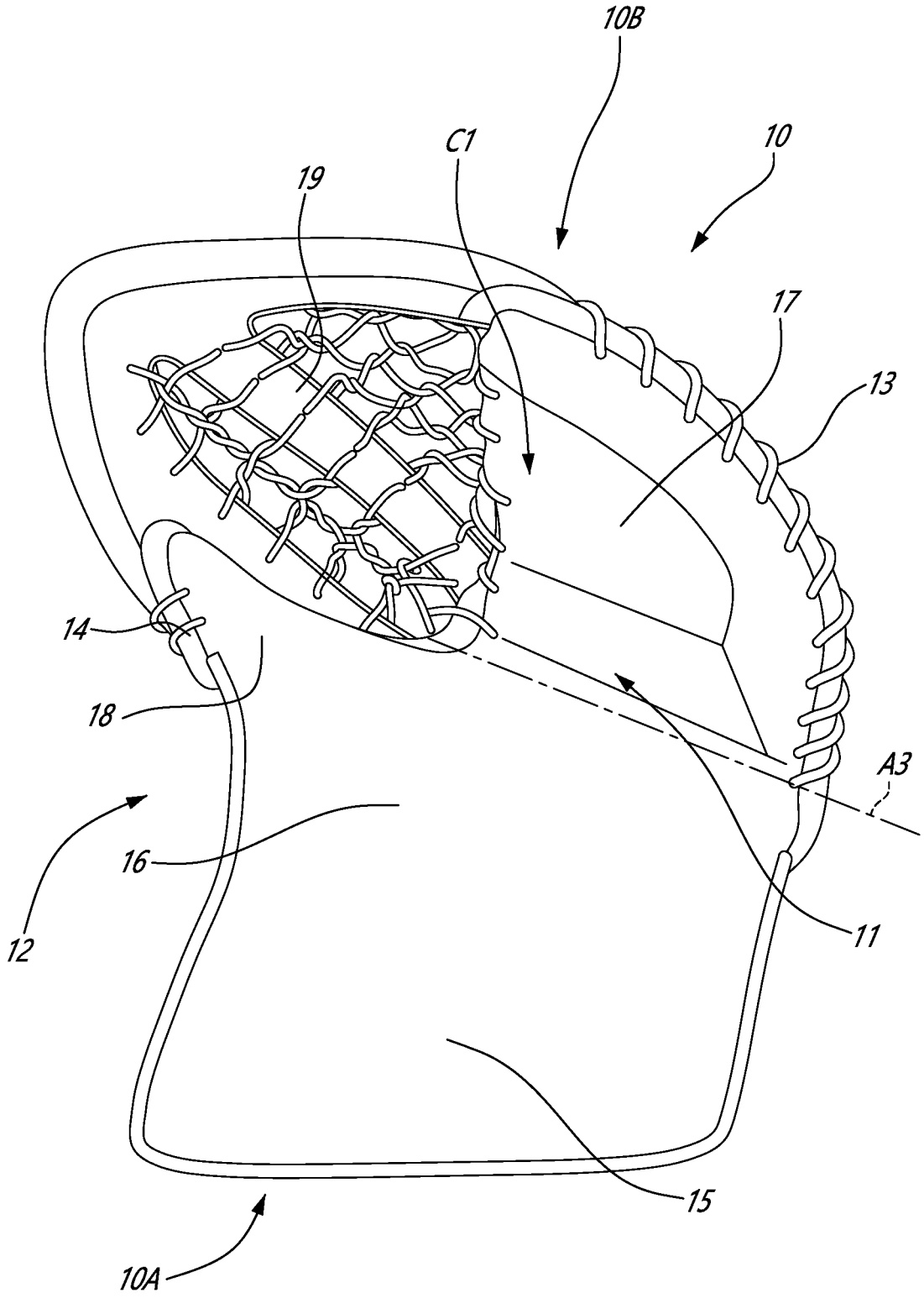
FIG. 2 is a schematic front view of a hockey goaltender glove in accordance with one embodiment.

Referring now to FIG. 2 showing a hockey goaltender glove 10, which will be referred to simply as a "glove" hereinbelow, with reference to the anatomy of the hand H as shown in FIG. 1. The glove 10 is sized to accommodate the hand H in a hand-receiving space defined between front and back sections, which will be further described below. The glove 10 has a front side 11 facing the palm P of the hand H and a rear side 12, opposed to the front side 11, and facing a back of the hand H. The glove 10 has a lateral side 13 and a medial side 14 opposed to the lateral side 13. The lateral side 13 is located adjacent a little finger of the fingers F whereas the medial side 14 is located adjacent the thumb T.

The glove 10 includes a wrist section 15, a hand or palm section 16, a finger section 17, and a thumb section 18. The glove 10 extends from a glove opening 10A for receiving the hand H to a glove end 10B opposite the glove opening 10A and proximate tips of the fingers F. The wrist section 15 leads to the palm section 16. The palm section 16 extends from the glove opening 10A, and the finger section 17 extends from the palm section 16 to the glove end 10B. A pocket 19 bridges a gap to connect the finger section 17 to the thumb section 18. The palm section 16 and the wrist section 15 have opposed front and back sides respectively facing palm and back sides of the hand H. In the embodiment shown, the hand H is positioned behind the wrist section 15 and the palm section 16. In other words, the palm P of the hand H faces the palm section 16. As will be discussed below, the hand H is inserted within a set of strappings that is connected behind the wrist section 15 and behind the palm section 16. The front side 11 defines a puck-receiving cavity C1 to contain a puck caught by the wearer.

In use, when the goaltender catches a puck, he or she closes his or her hand by pivoting the fingers F about the first pivot axis A1 (see FIG. 1). This has the effect of moving the finger section 17 of the glove 10 towards the thumb section 18 and towards the palm section 16 to enclose or trap the puck in the pocket 19. In other words, the glove 10 is movable from an open configuration of the glove 10 to a closed configuration of the glove 10 to close the puck-receiving cavity C1. However, current glove constructions do not define a definite hinge line of the glove, rendering the closing motion of the glove imprecise and variable from time to time, and which can change over time as the glove wears in. Hence, performance may be impaired. The glove 10 may at least partially alleviate these drawbacks with features that are described herein below.

Figure 3:
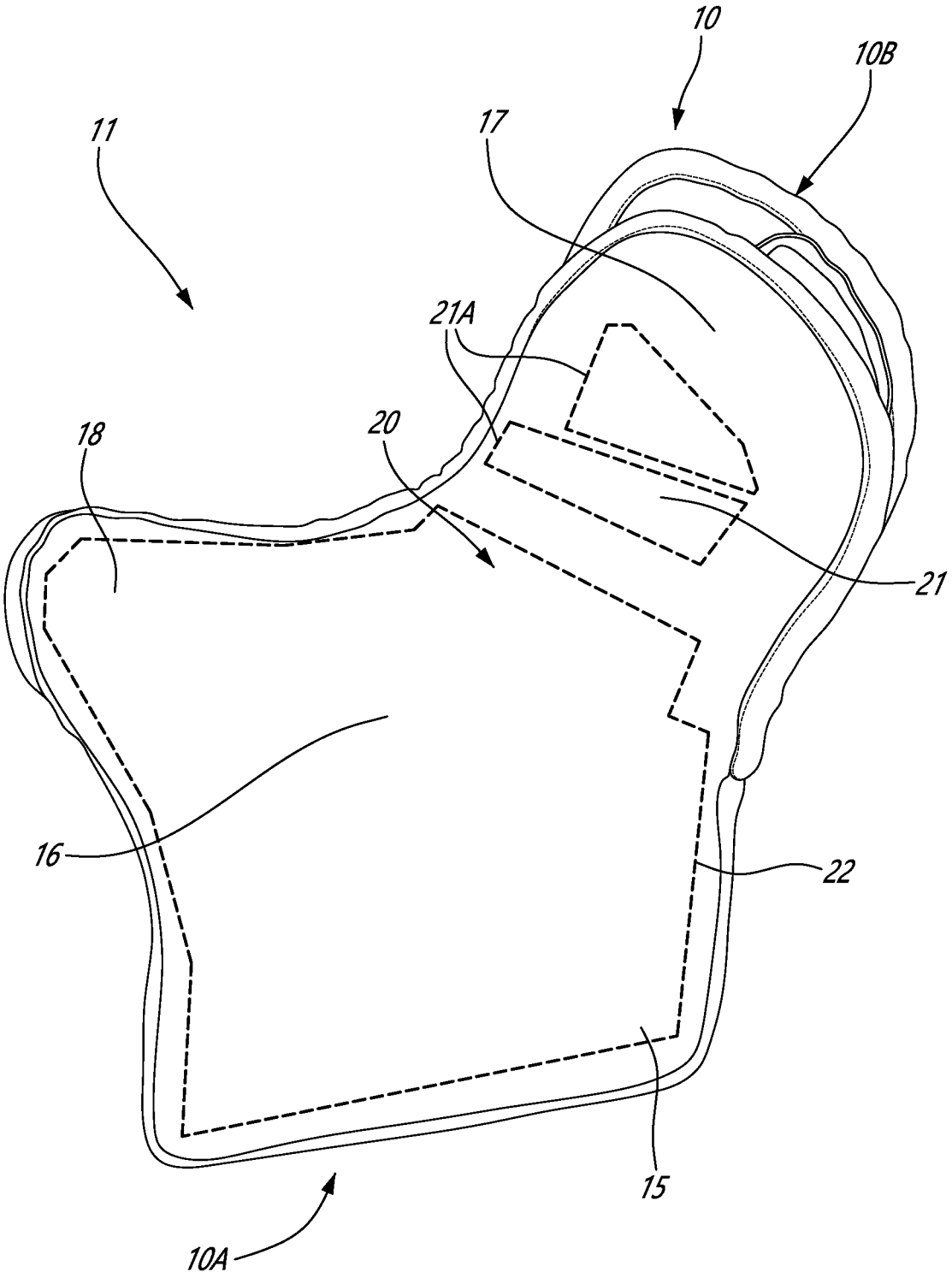
FIG. 3 is a front partially transparent view of the hockey goaltender glove of FIG. 2 with parts removed for illustration purposes.
Figure 4:
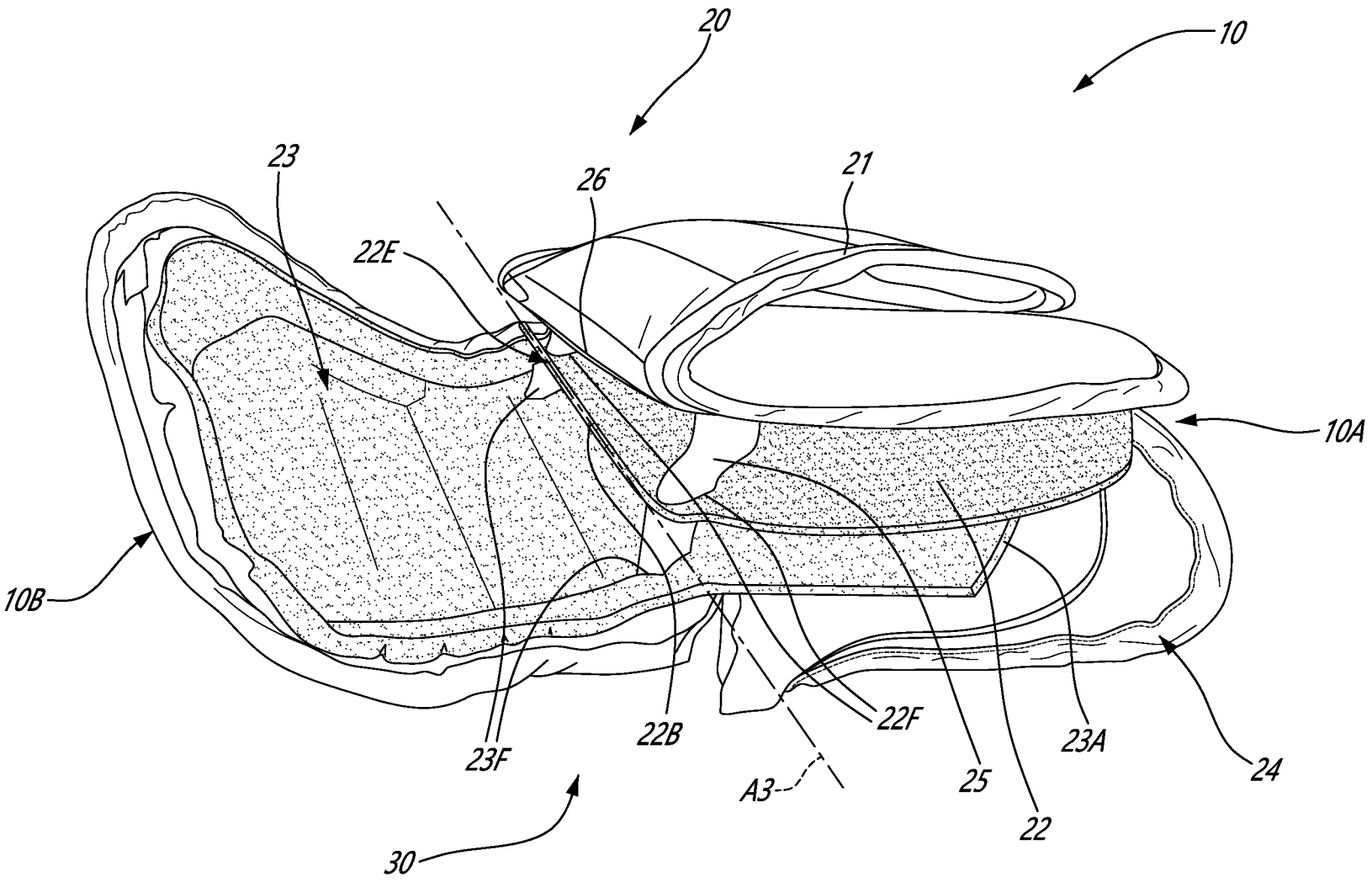
FIG. 4 is a side partially exploded view of the hockey goaltender glove of FIG. 3 illustrating a layered construction of the glove.

Referring more particularly to FIGS. 3-4, with continued reference to FIGS. 1-2, the glove 10 is shown with the pocket 19 removed for illustration purposes. The front side 11 of the glove 10 is shown in FIG. 3. The glove 10 includes a front assembly 20 and a rear assembly 30, which are described below with reference numerals in the 20's and 30's respectively. The front assembly 20 may be secured to the rear assembly 30 by stitching (and/or lacing) their respectively peripheries, leaving the glove opening 10A for receiving the hand H. In other words, the front assembly 20 and the rear assembly 30 define a hand-receiving space 32 between the front assembly 20 and the rear assembly 30 for receiving the hand H of the goaltender.

As shown in FIG. 3, the front assembly 20 includes a front skin 21 that is the visible part of the front side 11 of the glove 10. The front skin 21 may include padding elements 21A secured to an inner side thereof for the protection of the goaltender. Stitch lines may separate the padding elements 21A from one another. Those stich lines may also provide flexibility of the glove 10. The wrist section 15 may further includes one or more padding elements.

Figure 5:
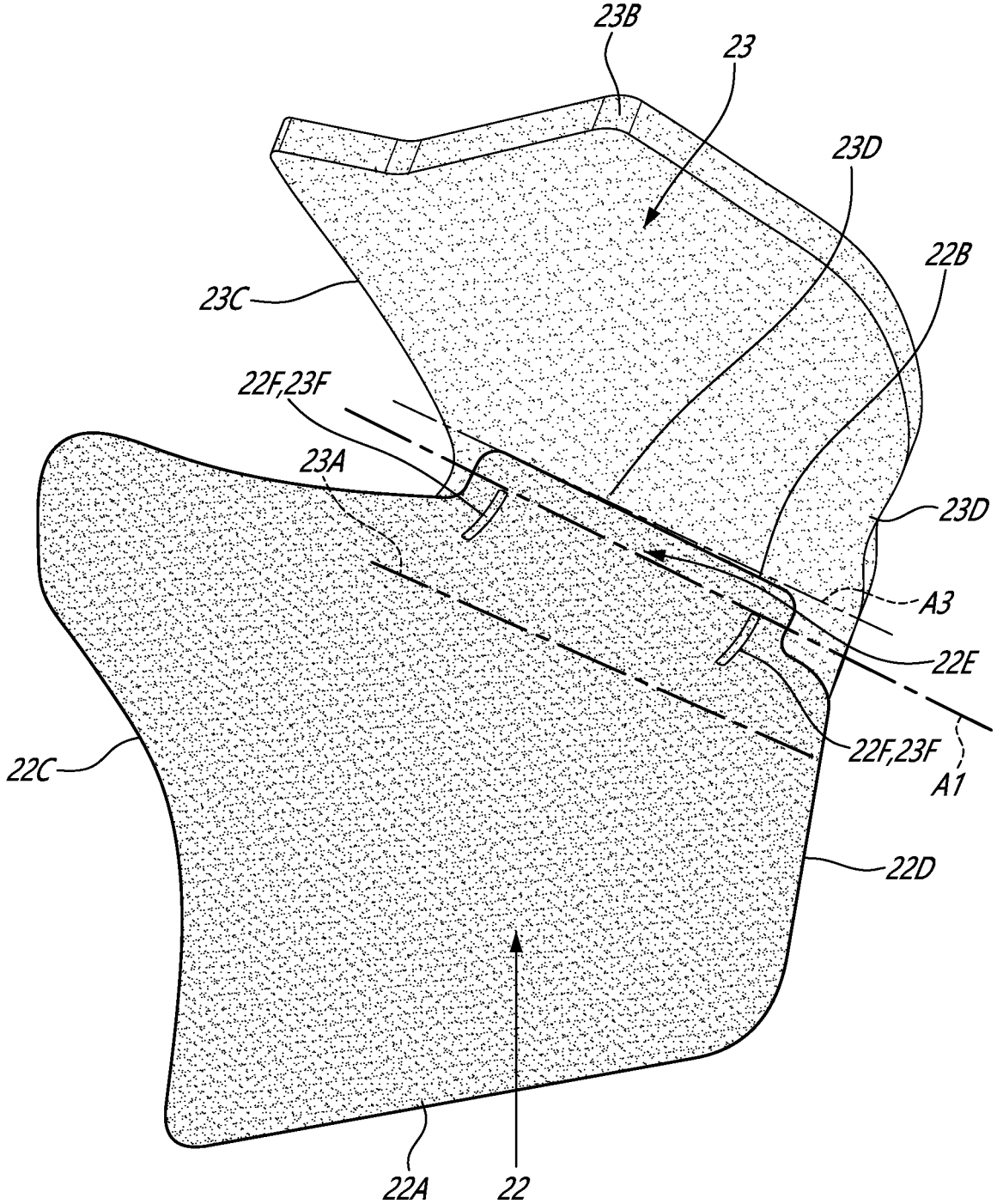
FIG. 5 is a front view of inner components of the hockey goaltender glove of FIG. 3.

Referring now more particularly to FIGS. 4-5, the glove 10 includes a palm protective member 22, which is part of the front assembly 20. The palm protective member 22 may be a unitary plastic element or may be a combination of EPP, high density foam and plastic positioned at various locations. The palm protective member 22 overlaps the palm section 16 and extends towards the finger section 17 of the palm section 16. The palm protective member 22 is located between the front side 11 and the hand-receiving space of the glove 10. In the embodiment shown, the palm protective member 22 further overlaps at least partially the thumb section 18. The finger section 17 is free of the palm protective member 22. The palm protective member 22 is used to protect the palm P of the goaltender and the wrist W of the goaltender, and overlies at least the palm P when the glove is worn.

As seen in FIG. 5, the palm protective member 22 includes a wrist edge 22A adjacent the wrist W (FIG. 1) of the goaltender and located proximate the glove opening 10A, a metacarpophalangeal edge, referred to below as a MCP edge 22B, opposed to the wrist edge 22A, a medial edge 22C extending from the wrist edge 22A to the MCP edge 22B, and a lateral edge 22D extending from the wrist edge 22A to the MCP edge 22B and being opposed to the medial edge 22C. The MCP edge 22B is located between the glove opening 10A and the glove end 10B and proximate to the MCP joints K (FIG. 6) of the hand of the wearer. As shown more clearly in FIG. 4, the palm protective member 22 includes a curved portion 22E that extends from the MCP edge 22B towards the wrist edge 22A. The curved portion 22E ends at the MCP edge 22B. This curved portion 22E curves inwardly to follow a natural shape of the fingers F when they are pivoted about the first axis A1 (FIG. 1) as will be further explained below. The palm protective member 22 may be made of any suitable material providing the required protection to the palm P and wrist W of the goaltender. In the present embodiment, the palm protective member 22 is made of a plastic material.

Still referring to FIG. 5, the glove 10 further includes a finger padding 23, also referred to as a finger foam. The finger padding 23 defines a palm edge 23A, which is depicted here with a dashed line since it is located behind the palm protective member 22, a tip edge 23B opposed to the palm edge 23A and located proximate the glove end 10B, a medial edge 23C extending from the palm edge 23A to the tip edge 23B, and a lateral edge 23D opposite the medial edge 23C and extending from the palm edge 23A to the tip edge 23B. The finger padding 23 may be made of a foam or any other material that may provide suitable protection to the fingers F of the goaltender when he or she is catching a puck and that is suitably flexible to allow the glove 10 to be closed by a force exerted by the fingers F of the goaltender. The palm protective member 22 has a stiffness greater than that of the finger padding 23 such that the palm protective member 22 is substantially non-flexible relative to the finger padding 23, although a certain degree of flexion is acceptable.

Still referring to FIGS. 4-5, the finger padding 23 and the palm protective member 22 overlap one another such that a portion of the finger padding 23 may be sandwiched between the hand H of the goaltender and the palm protective member 22. This may provide better comfort and impact absorption to the goal tender when he or she is catching a puck. As shown more clearly in FIG. 4, a wrist padding 24 is disposed atop the finger padding 23 such that a portion of the finger padding 23 is sandwiched between the palm protective member 22 and the wrist padding 24. The wrist padding 24 may be made of any suitable padding material, such as foam and so on.

Figure 6:
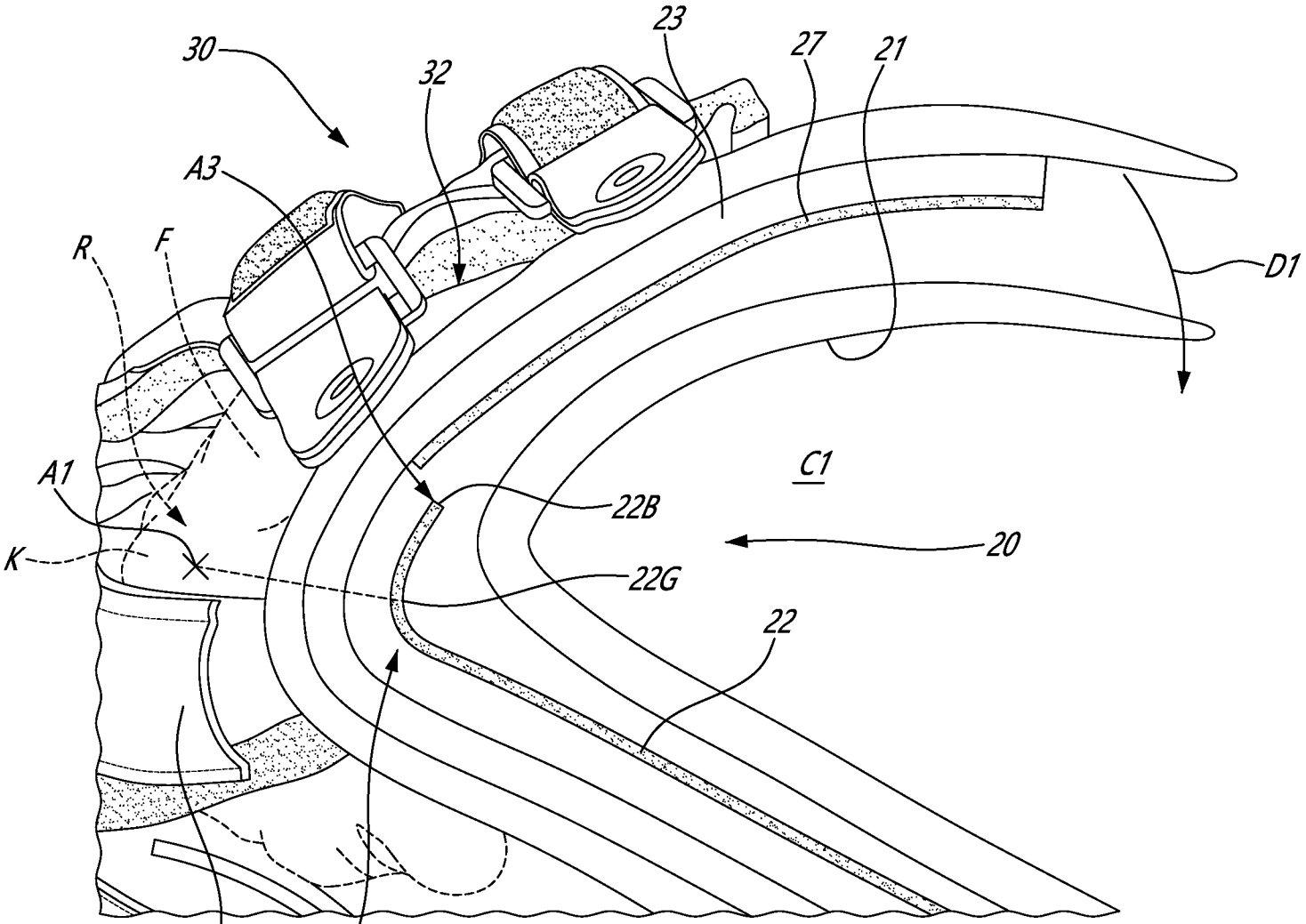
FIG. 6 is a side partially exploded view of the hockey goaltender glove of FIG. 3 illustrating inner components thereof.

Referring more particularly to FIG. 6, a finger protective member 27, which may be made of the same material as the palm protective member 22, is added in front of the finger padding 23. Therefore, in use, the fingers F of the wearer will lay against the finger padding 23, which will lay over the finger protective member 27. Put differently, the finger padding 23 is sandwiched between the fingers F and the finger protective member 27. The finger protective member 27 and the palm protective member 22 may be contiguous. That is, the MCP edge 22B of the palm protective member 22 may be substantially in register with an edge of the finger protective member 27. Alternatively, the finger protective member 27 and the palm protective member 22 may overlap one another. Alternately, a small gap may be present between the MCP edge 22B of the palm protective member 22 and the edge of the finger protective member 27.

In the depicted embodiment, the MCP edge 22B of the palm protective member 22 is located above the metacarpophalangeal (MCP) joints, or the knuckles K, of the hand H of the wearer. In other words, the MCP edge 22B may be offset from the knuckles K and offset from the first pivot axis A1 along a direction being parallel to the fingers F. The MCP edge 22B may be closer to the tips of the fingers F than the first pivot axis A1. In the embodiment shown, the curved portion 22E of the palm protective member 22 has a bottom-most location 22G, which may be seen as an apex of the curved portion 22E. This bottom-most location 22G may correspond to a location where a curvature of the curved portion 22E is minimal. It may correspond to a location where the curved portion changes direction from being oriented towards the knuckles K to being directed away from the knuckles K. The first pivot axis A1, and the knuckles K, may be substantially aligned with the bottom-most location 22G of the curved portion 22E of the palm protective member 22. Put differently, the bottom-most location 22G of the curved portion 22E of the palm protective member 22 may sit below the first pivot axis A1 or being substantially aligned with the first pivot axis A1 but may not be substantially above the first pivot axis A1 to avoid interfering with the fingers F bending along the first pivot axis A1. Herein, the expression "substantially" is meant to encompass slight variations due to manufacturing tolerances.

Consequently, the front assembly 20 of the glove 10 is pivotable, along direction D1, between open and closed configurations of the glove 10 solely along a single hinge line A3 (FIG. 5), which is defined by the MCP edge 22B of the palm protective member 22. Hence, when the goaltender moves his or her fingers F to close his or her hand, the fingers F bend the finger padding 23 in relationship to the palm protective member 22 about the single hinge line A3, which is defined by the MCP edge 22B of the palm protective member 22. Stated differently, the MCP edge 22B defines the single hinge line A3 about which the finger section 17 of the glove 10 bends in relationship to the palm section 16 of the glove 10 from the open configuration to the closed configuration of the glove 10 to close the puck-receiving cavity C1. Thus, in the embodiment shown, the MCP edge 22B of the palm protective member 22, which defines the third pivot axis A3, is located past the first pivot axis A1 relative to a direction extending towards tips of the fingers F. The curved portion 22E of the palm protective member 22 therefore overlies the knuckles K of the hand H of the wearer. The fingers F, and the finger padding 23, wrap around the MCP edge 22B and follow a shape of the curved portion 22E of the palm protective member 22. This may provide a smooth, consistent, and comfortable closing motion of the hand H of the goaltender.

The MCP edge 22B of the palm protective member 22 may define a single living hinge of the finger padding 23. The disclosed glove 10, thanks to the single hinge line A3 provided by the palm protective member 22, may provide a constant and uniform movement of the glove 10 between the open and closed positions. It may also offer more uniformity in the manufacturing of the gloves 10 such that there may be less variability in the different gloves.

The location of the single hinge line A3 that registers with the MCP edge 22B of the palm protective member 22 and that sits above the knuckles K and above the first pivot axis A1 may guide the motion of the fingers F between the open and closed configurations of the glove 10 to close the puck-receiving cavity C1. It may be easier to close the glove 10 thanks to this single hinge line A3. The curved portion 22E of the palm protective member 22 may further help guiding the glove towards the closed position since the fingers F may naturally wrap around this curved portion 22E. This may further help the closing motion of the glove 10. The closing of the glove 10 may feel more natural to the goaltender thanks to this single hinge line A3.

Figure 8:
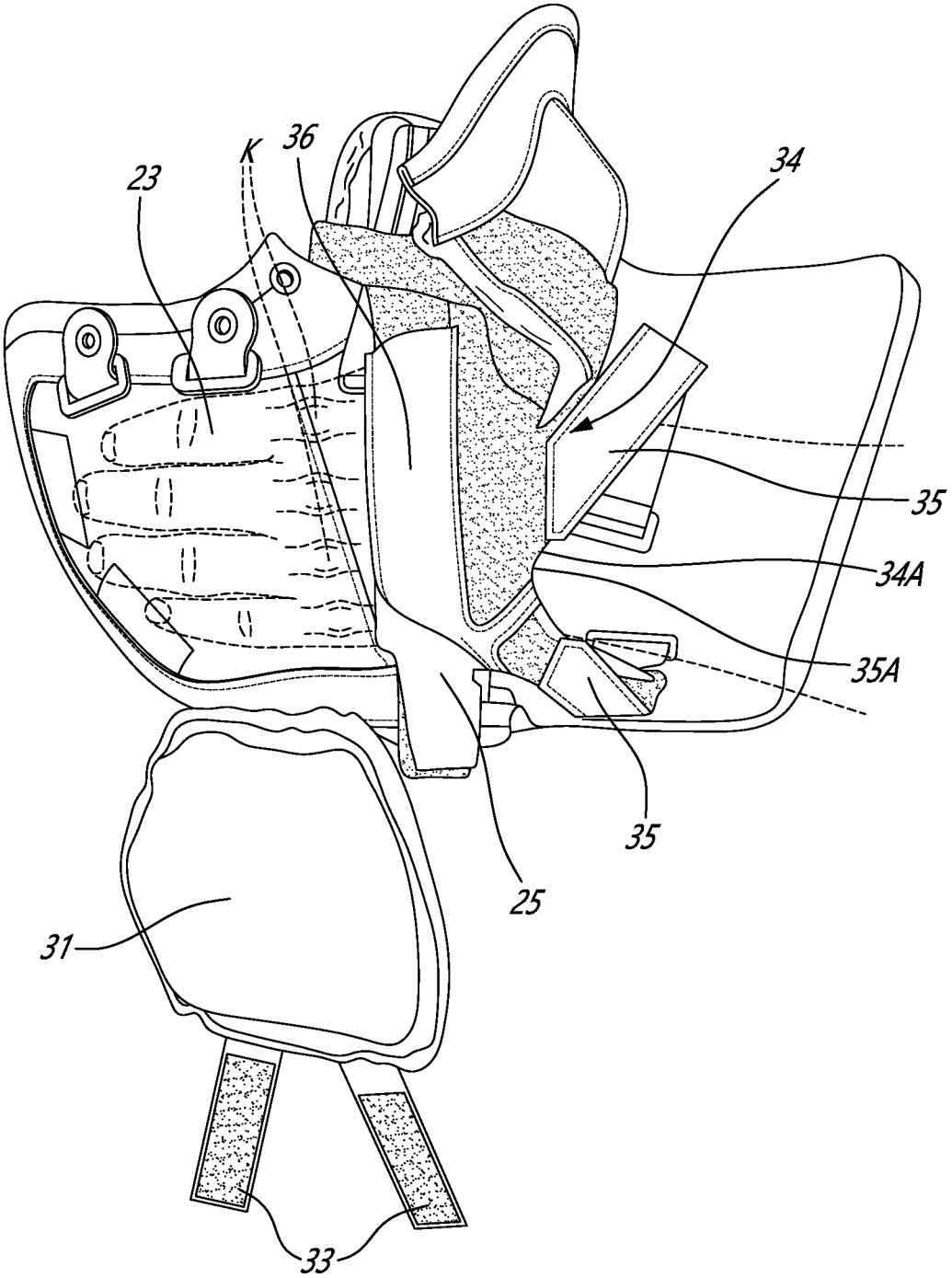
FIG. 8 is another back view of the hockey goaltender glove of FIG. 3 with a hand of a wearer shown for illustration purposes.

Referring back to FIGS. 4-5 and 8, in the embodiment shown, a strap 25 connects the finger padding 23 to the palm protective member 22 and to the front skin 21. The strap 25 extends through a pair of first slots 22F defined through the palm protective member 22 and through a pair of second slots 23F defined through the finger padding 23. The first slots 22F are in register with the second slots 23F to receive the strap 25. A sleeve 26 is secured to the front skin 21 and slidably receives the strap 25. The strap 25 then extends through the finger padding 23 to reach the back side of the finger padding 23. The strap 25 therefore defines a full loop around the hand H of the goaltender. In other words, the strap 25 extends a full circumference around the hand-receiving space 32 of the glove 10. As shown in FIG. 8, the strap 25 may overlap the hand H slightly below the knuckles K of the hand H. The strap 25 may be in register with the curved portion 22E of the palm protective member 22. This may provide a better "hugging" feeling to the goaltender's hand and a more secure attachment to the hand H. In the present embodiment, the palm protective member 22 is secured to the finger padding 23 solely via the strap 25. As shown in FIG. 5, the finger padding 23 protrudes beyond lateral and medial edges of the curved portion 22E of the palm protective member 22. This may ease the lacing of a back padding of the rear assembly 30 to the front assembly 20. As shown in FIG. 8, in the present embodiment, the strap 25 that runs through the first slots 22F further wraps around the back of the hand, and sits below the knuckles K. In other words, the strap 25 is offset from the knuckles K of the hand H of the wearer. The knuckles K are therefore located closer to the glove end 10B than the strap 25. This may provide a tight connection between the top of the back of the hand H of the wearer and the palm protective member 22. In turn, this may enable a better hugging feeling of the glove 10 on the hand H.

Figure 7:
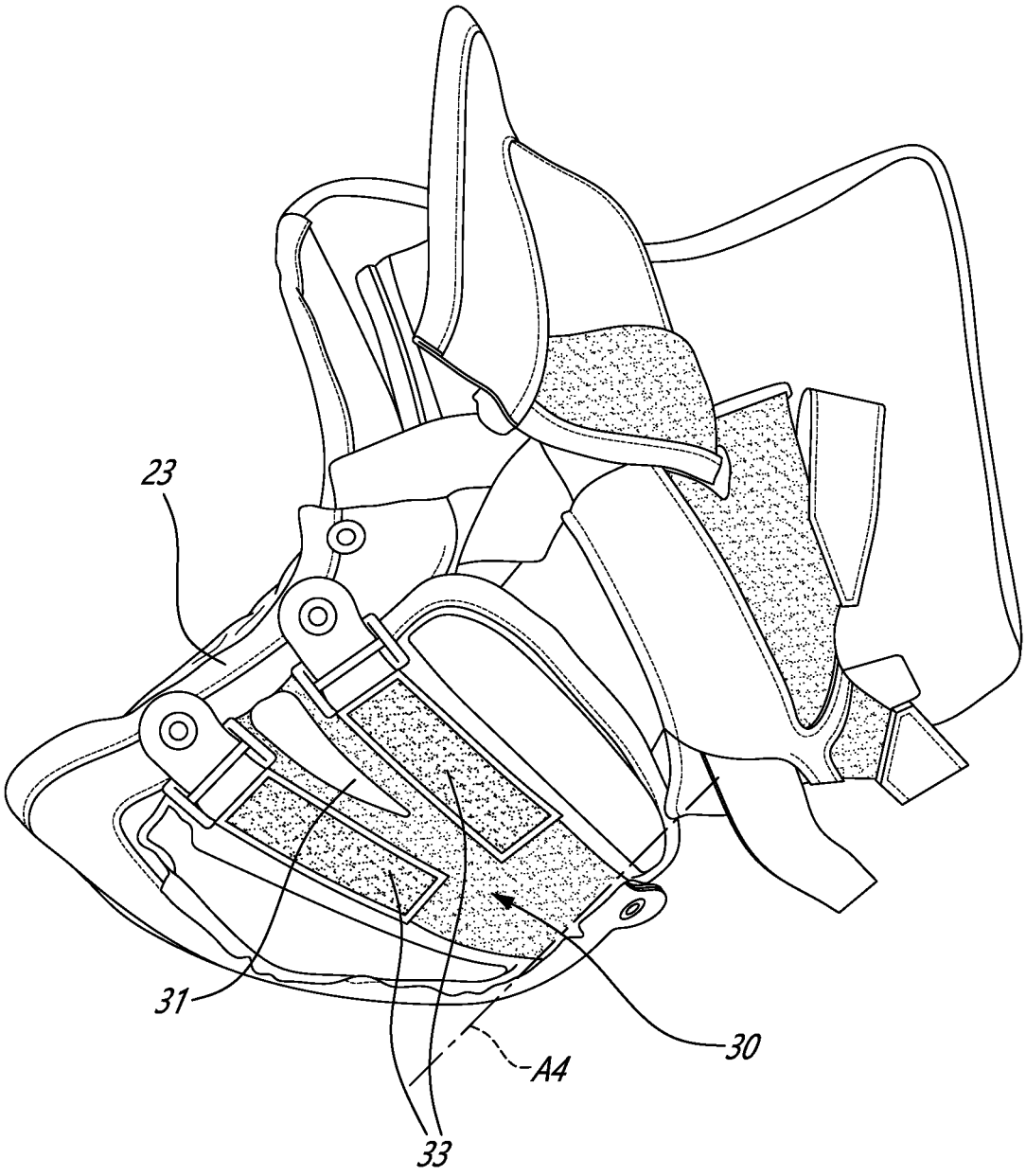
FIG. 7 is a back view of the hockey goaltender glove of FIG. 3.
Figure 9:
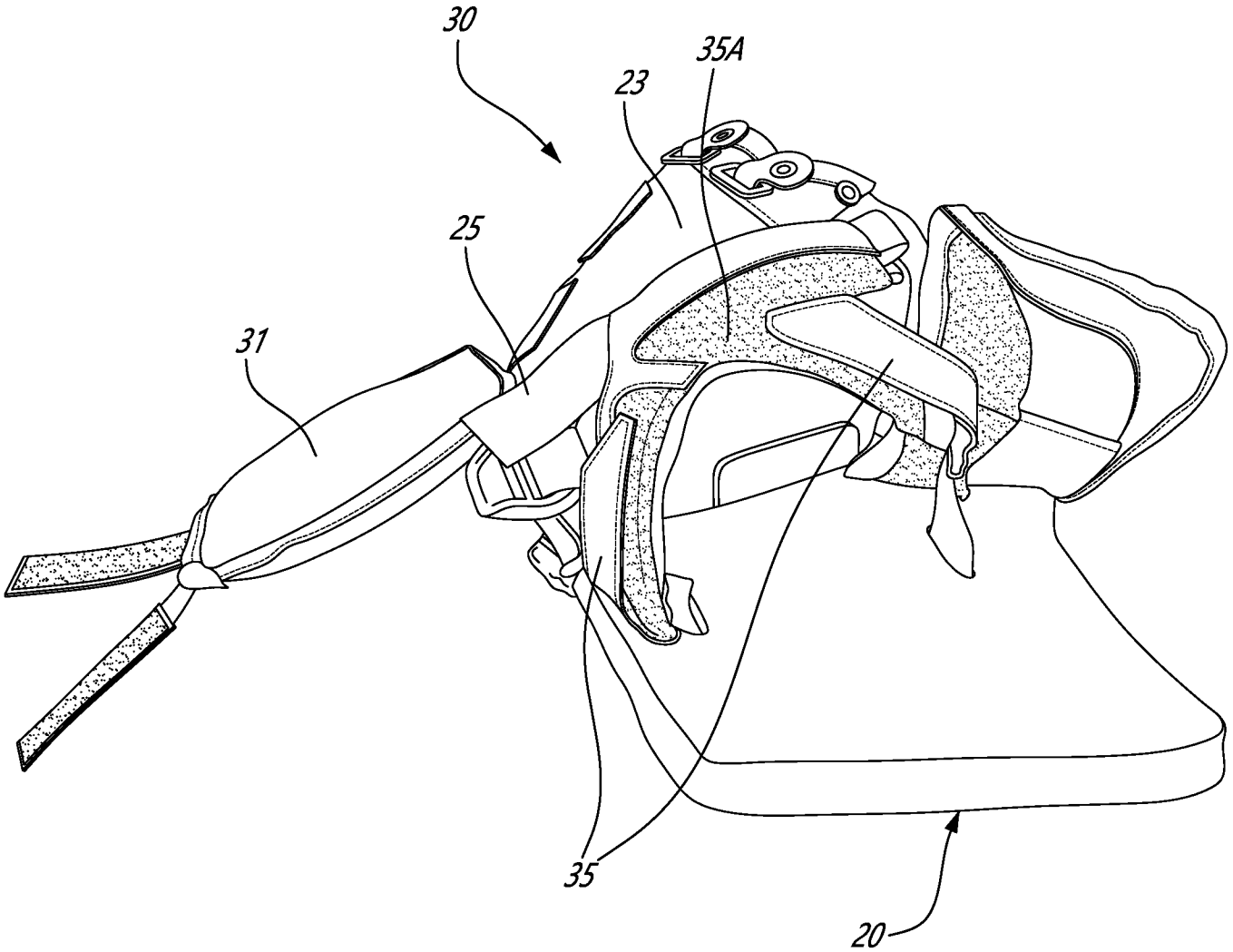
FIG. 9 is a rear view of the hockey goaltender glove of FIG. 3.

Referring more particularly to FIGS. 7-9, the rear assembly 30 is described in detail. In the embodiment shown, the rear assembly 30 includes a rear padding 31 that is pivotable relative to the finger padding 23 about a fourth axis A4, which may be located on the lateral side of the glove 10. The hand-receiving space 32 (FIG. 6) is defined between the rear padding 31 and the finger padding 23 and is sized for receiving the fingers F of the hand H of the goaltender. Straps 33, two in the embodiment shown but more or less is contemplated, are used to secure the rear padding 31 to the finger padding 23. The straps 33 may include any suitable fastening means, such as snap buttons or hook and loop fasteners as depicted. In some embodiments, stitching may alternatively be used.

In the present case, all of the four fingers F are in the hand-receiving space 32 and are not separated from one another. In other words, the hand-receiving space 32 has a width sized to accept all of the four fingers F, and is thus free of internal finger gussets. This "mitten" configuration may increase a force transmitted by the fingers F to the finger padding 23 for closing the glove 10 to catch the puck. This may allow an increase in the performance of the goaltender since the time required to close the glove 10 may be shorten thanks to this configuration in which the fingers F are not isolated from each other. In some embodiments, the fingers F may be separated from one another.

Referring more particularly to FIGS. 8-9, the glove includes a hand strap 34 that is spaced apart from the front assembly 20 to receive the hand H of the goaltender. The strap 25 wraps around the hand strap 34 to bias the hand strap 34 against the back side of the hand H of the goaltender. The strap 25 is slidably received within a sleeve 36 secured to the hand strap 34 to guide the strap 25. The hand strap 34 is secured to the front assembly 20 via the strap 25 and via two adjustable strap portions 35 that are located on both sides of a passage for receiving the hand H of the goaltender. Each of the two adjustable strap portions 35 is secured to the front assembly 20 at two spaced-apart locations. Hook and loop fasteners or any other suitable means may be used to secure and adjust the two adjustable strap portions 35 to the front assembly 20.

In the depicted embodiment, the two adjustable strap portions 35 are angled one relative to the other. Thus, a bottom edge of the hand strap 34 and the two adjustable strap portions 35 defines a U-shaped bottom edge 34A. A center portion 35A of the U-shaped bottom edge 34A is located above the wrist W such that a movement of the hand H relative to the wrist about the second pivot axis A2 (FIG. 1) is substantially unimpeded by the rear assembly 30. Put differently, the U-shaped bottom edge 34A extends from a first location of the two spaced-apart locations towards the center portion 35A and extends from the center portion 35A towards a second location of the two spaced-apart locations; the center portion 35A being substantially aligned with the second pivot axis A2. Thus, the U-shape of the hand strap 34 may provide a clearance of the wrist W that may ease a backward rotation of the hand relative to the wrist W of the goaltender. Hence, the goaltender may more easily maintain a baseline position when playing hockey.

The strap 25, which extends through the slot 22F of the palm protective member 22 sits higher on the hand H and closer to the finger F compared to a classical configuration. The strap 25 extending all around the hand H and closer to hand pivot axis A1 may further provide a better holding of the hand H and a better feel and performance to the goaltender. The absence of finger gusset, provided by the hand-receiving space 32 may contribute in increasing a force transmitted from the fingers F to the glove 10, which may improve performance of the goaltender The disclosed glove 10, thanks to the MCP edge 22B of the palm protective member 22, may define a single break point with more precision which may improve consistency. This palm protective member 22 may allow the incorporation of the first slots 22F that receive the strap 25 used to assemble the hand strap 34. The curved shape of the palm protective member 22 may provide a more ergonomic fit for the hand of the wearer. Having the hand of the wearer rest directly on the core of the glove 10 may provide a more direct connection to the finger padding 23. This may result in more responsiveness of the glove 10. The removal of the finger gussets may help increase air flow and keep the wearer cooler and dryer and it may secure the hand of the wearer more firmly to reduce the lateral motion of the hand. This may allow the hand of the wearer to be tightly secured to the finger padding 23. The palm protective member 22, thanks to its MCP edge 22B sitting at the roots R of the fingers F, may allow the use of the strap 25 to secure all sections together instead of having to stitch all of the sections. Manufacturing may be simpler, which may result in production efficiency gains.

As can be seen therefore, the examples described above and illustrated are intended to be exemplary only. The scope is indicated by the appended claims.

What is claimed is:

1. A hockey goaltender glove, comprising:

a front side at least partially defining a puck-receiving cavity, a rear side opposite the front side, the front side and the rear side extending from a glove opening for receiving a hand of a wearer to a glove end opposite the glove opening, a palm section extending from the glove opening and a finger section extending from the palm section to the glove end, and a hand-receiving space being defined between the front side and the rear side and communicating with the glove opening; and a palm protective member located between the front side and the hand-receiving space, the palm protective member having a wrist edge proximate the opening, a metacarpophalangeal (MCP) edge opposite the wrist edge, the MCP edge located between the glove opening and the glove end and configured to be above MCP joints of the hand of the wearer, and a curved portion ending at the MCP edge, the curved portion curving toward the puck-receiving cavity and thereby adapted to curve away from a palm of the hand of the wearer;

wherein the MCP edge defines a single hinge line about which the finger section bends in relationship to the palm section, when the hockey goaltender glove is moved from an open configuration to a closed configuration to close the puck-receiving cavity.

2. The hockey goaltender glove of claim 1, wherein the curved portion extends from an apex to the MCP edge, the apex of the curved portion corresponding to a location where the curvature of the curved portion is minimal and being configured to be substantially aligned with the MCP joints of the hand of the wearer.

3. The hockey goaltender glove of claim 1, comprising a finger padding secured to the palm protective member, the palm protective member having a stiffness greater than that of the finger padding, the finger padding extending from a location proximate or at the glove end towards the wrist edge.

4. The hockey goaltender glove of claim 1, comprising a strap extending through slots defined by the palm protective member, the strap defining a full loop around the hand-receiving space.

5. The hockey goaltender glove of claim 4, wherein the strap is in register with the curved portion of the palm protective member.

6. The hockey goaltender glove of claim 1, comprising a rear assembly located between the rear side and the hand-receiving space, the rear assembly including straps for securing the hand within the hand-receiving space, the straps including a first strap wrapping around the hand-receiving space.

7. The hockey goaltender glove of claim 6, wherein the first strap extends a full circumference around the hand-receiving space.

8. The hockey goaltender glove of claim 6, comprising a front assembly defining the front side, the straps including a hand strap connected to the front assembly at two spaced-apart locations, the hand strap extending partially around the hand-receiving space.

9. The hockey goaltender glove of claim 8, wherein the hand strap has a bottom edge being U-shaped, the bottom edge extending from a first location of the two spaced-apart locations towards a center portion of the hand strap, and extending from the center portion towards a second location of the two spaced-apart locations, the center portion substantially aligned with a pivot axis of a wrist of the wearer.

10. The hockey goaltender glove of claim 9, wherein the hand strap has two adjustable strap portions each extending from a respective one of the first location and the second location towards the center portion.

11. The hockey goaltender glove of claim 9, wherein the first strap is slidably received within a sleeve defined by the hand strap.

12. The hockey goaltender glove of claim 1, comprising a finger protective member located between the front side and the hand-receiving space, the finger protective member extending from the glove end towards the palm protective member.

13. The hockey goaltender glove of claim 12, wherein the finger protective member has a bottom edge aligned with or proximate the MCP edge of the palm protective member.

14. The hockey goaltender glove of claim 12, wherein the finger protective member is slidable relative to a front skin defining the front side.

15. A hockey goaltender glove adapted to be worn on a hand of a wearer, the hockey goaltender glove comprising:

a palm section, a thumb section extending from the palm section and configured for receiving a thumb, and a finger section extending from the palm section and configured for receiving fingers;

a pocket bridging a gap between the finger section and the thumb section;

a wrist section defining an opening of the hockey goaltender glove, the opening configured for receiving the hand when inserted in the hockey goaltender glove, the wrist section leading to the palm section; and a palm protective member adapted to face a palm side of the hand and overlapping the wrist section and extending towards the finger section, the palm protective member having a wrist edge adapted to be proximate a wrist of the hand, a metacarpophalangeal (MCP) edge opposite the wrist edge, a lateral edge extending from the wrist edge to the MCP edge, and a medial edge opposite the lateral edge and extending from the wrist edge to the MCP edge, the MCP edge adapted to be located above MCP joints of the hand of the wearer, the MCP edge defining a single hinge line about which the finger section bends in relationship with the palm section from an open configuration of the hockey goaltender glove to a closed configuration of the hockey goaltender glove.

16. The hockey goaltender glove of claim 15, wherein the palm protective member has a curved portion extending from the MCP edge towards the wrist edge, the curved portion configured to curve away from the palm and to follow a shape of the fingers.

17. The hockey goaltender glove of claim 16, wherein the curved portion extends from an apex to the MCP edge, the apex of the curved portion corresponding to a location where the curvature of the curved portion is minimal and being adapted to be substantially aligned with the MCP joints of the hand of the wearer.

18. The hockey goaltender glove of claim 15, comprising a finger padding secured to the palm protective member, the palm protective member having a stiffness greater than that of the finger padding, the finger padding extending within the finger section and covering at least a portion of a palm of the hand.

19. The hockey goaltender glove of claim 18, comprising a strap extending through registering slots defined by the palm protective member and by the finger padding, the strap defining a full loop around the palm section that receives the hand.

20. The hockey goaltender glove of claim 19, wherein the strap sits below the MCP joints of the hand of the wearer.

* * * * *